United States Patent [19]

Pressler

[11] Patent Number: 4,473,159

[45] Date of Patent: Sep. 25, 1984

[54] ROTATING TRASH CAN RACK

[76] Inventor: Larry E. Pressler, 325 North 7th, McAllen, Tex. 78501

[21] Appl. No.: 359,598

[22] Filed: Mar. 18, 1982

[51] Int. Cl.[3] ..... A47F 5/00

[52] U.S. Cl. ..... 211/78; 211/169; 248/DIG. 7; 248/202.1

[58] Field of Search ..... 211/78, 80, 81, 95, 211/77, 169; 232/43.4, 41.3, 43.3; 248/202.1, 131, DIG. 7; 312/326, 329; 256/32, 34; 44/42, 381, 37

[56] References Cited

U.S. PATENT DOCUMENTS

| | | | |
|---|---|---|---|
| 1,058,612 | 4/1913 | Maloney | 49/42 |
| 1,630,200 | 5/1927 | Merrill | 49/42 |
| 1,684,578 | 9/1928 | Edwards | 49/42 X |
| 2,905,518 | 9/1959 | Doesken | 312/326 X |
| 2,908,396 | 10/1959 | Odlozil | 248/DIG. 7 |
| 3,101,227 | 8/1963 | Pugh | 312/326 X |
| 3,186,555 | 6/1965 | Ventura | 248/DIG. 7 |
| 3,188,159 | 6/1965 | Wenger et al. | 312/326 X |
| 3,407,941 | 10/1968 | Schmidt | 248/DIG. 7 |
| 3,593,993 | 7/1971 | Bonneau | 248/DIG. 7 |

*Primary Examiner*—William H. Schultz
*Assistant Examiner*—Robert W. Gibson, Jr.
*Attorney, Agent, or Firm*—Harvey B. Jacobson

[57] ABSTRACT

A fence section is provided extending between a pair of supporting posts and the section incorporates an upstanding stationary frame defining a horizontal opening through the fence section. An inner frame is received in the stationary frame and supported within the latter for swinging at least substantially 180° relative to the stationary frame about an upstanding axis between end-to-end and side-to-side reversed positions with the inner frame generally coplanar with the stationary frame and fence section. The inner frame includes fence panel structure supported therefrom preventing passage horizontally through the inner frame and support structure is provided on one side of the fence panel structure for removably supporting a trash receptacle therefrom swingable through the opening upon swinging of the inner frame between the aforementioned reversed positions thereof to shift the receptacle from a position supported on one side of the fence section to the other side of the fence section independent of removal of the receptacle from the support structure.

9 Claims, 8 Drawing Figures

ROTATING TRASH CAN RACK

BACKGROUND OF THE INVENTION

In various localities where domestic trash pick-ups are accomplished by private trash collecting firms or municipal trash collecting agencies, the domestic trash receptacles from which trash is to be collected may not be positioned on the inside of a fenced area requiring the trash collecting workers to enter the fenced areas. Accordingly, if a homeowner wishes to maintain his trash receptacles within a fenced area and to thereby prevent loose neighborhood dogs from gaining access to his trash, the homeowner must pick up and carry the trash receptacles to the exterior of the fenced area on trash pick-up days. Further, some municipalities require that trash receptacles be supported in an elevated position above the ground in order to discourage rodents and other undesirables from gaining access to the trash. Accordingly, a need exists for an improved elevated support for trash receptacles and including structure whereby the trash receptacle may be more readily shifted from within a fenced area to the outside of the fenced area on trash pick-up days.

Examples of previously patented structures, including some of the general structural and operational features of the instant invention are disclosed in U.S. Pat. Nos. 447,819, 542,347, 2,582,906 and 3,491,895.

SUMMARY OF THE INVENTION

The trash receptacle rack of the instant invention is supported from a fence panel component on one side thereof and with the fence panel component swingably supported intermediate its opposite ends for swinging about a vertical axis between end-to-end and side-to-side reversed positions relative to a fence section from which the panel is supported and relative to which the panel is generally coplanar when disposed in either of its reversed positions. The panel includes trash receptacles support structure on one side thereof from which trash receptacles may be removably supported and with trash receptacles supported from the support structure on one side of the panel, the panel may be swung from one position to the reverse position thereof in order to swing the receptacles from one side of the associated fence section to the other side thereof. The trash receptacle support structure carried by the panel is arranged to support the associated trash receptacles in an elevated position above the ground and in this manner extremely little effort is required on trash pick-up days to move trash receptacles from elevated positions within a fenced area to elevated positions outside the fenced area. Of course, the panel includes latch structure whereby the panel may be latched in either of its reversed positions.

The main object of this invention is to provide a trash receptacle support structure which will be capable of supporting trash receptacle in an elevated position above the ground and which further includes structure enabling the supported trash receptacles to be readily shifted in position from one side of a fence to the other side thereof.

Another object of this invention is to provide a trash receptacle support structure in accordance with the preceding object and which may be utilized in conjunction with substantially all forms of fences.

Another very important object of this invention is to provide a trash receptacle support structure including features thereof which prevent accidental dislodgement of the supported trash receptacles therefrom.

Yet another important object of this invention is to provide a trash receptacle support structure which may be sold in kit form and readily installed by a homeowner through the utilization of a minimal number of hand tools.

A final object of this invention to be specifically enumerated herein is to provide an apparatus in accordance with the preceding objects and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
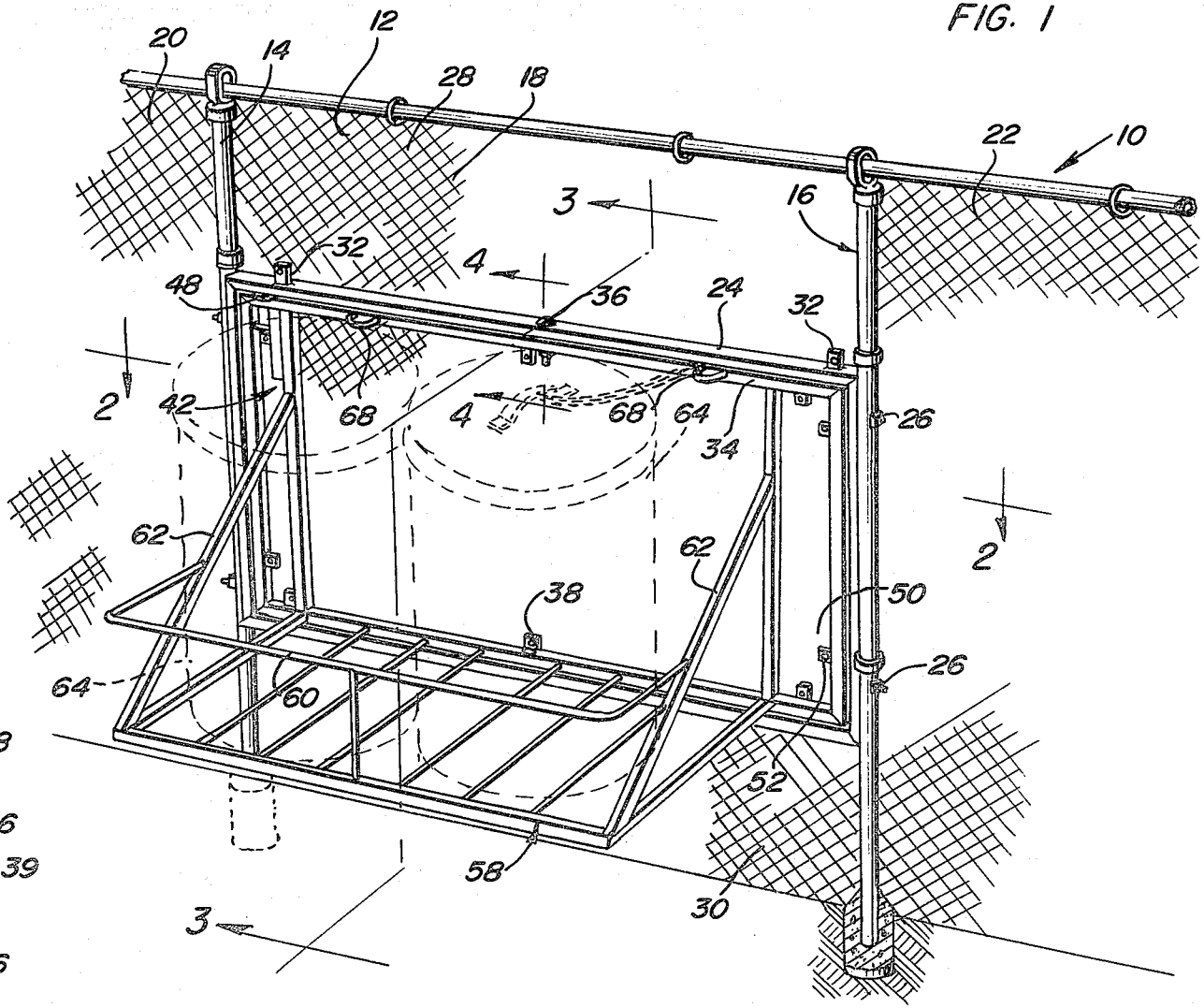
FIG. 1 is a fragmentary perspective view of a conventional form of "anchor"-type fence with the rotating trash can rack incorporated therein.

Referring now more specifically to the drawings, the numeral 10 generally designates an "anchor"-type fence construction including a section 12 extending between adjacent fence posts 14 and 16. The fence section 12 includes a panel 18 of woven fence wire and the panel 18 may be integral with the panels 20 and 22 disposed on the remote sides of the posts 14 and 16, as is conventional.

The fence section 12 incorporates therein a stationary frame 24 extending between and supported from the fence posts 14 and 16 through the utilization of suitable fasteners 26. The fence section 12 includes upper and lower portions 28 and 30 thereof disposed above and below the frame 24 and which are anchored to upper and lower marginal portions of the frame 24 at their lower and upper marginal edges, respectively, by anchor tabs 32 carried by the frame 24.

Inasmuch as the fence section 12 and the sections 20 and 22 are disposed on corresponding sides of the posts 14 and 16, the frame 24 may be mounted between the posts 14 and 16 independent of any modification of the panel 18. However, after the frame 24 has been mounted between the posts 14 and 16, and the lower marginal edge of the portion 28 and the upper marginal edge of the portion 30 have been anchored to the tabs 32 by suitable fastening means, the portions of the panel 18 registered with the upper and lower and upstanding marginal portions of the frame 24 may be cut away in order to form an opening through the panel 18 bound by the frame 24.

Figure 7:
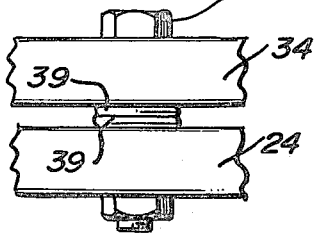
FIG. 7 is an enlarged fragmentary elevational view illustrating a typical pivot connection between the stationary and inner frame portions of the rack.
Figure 4:
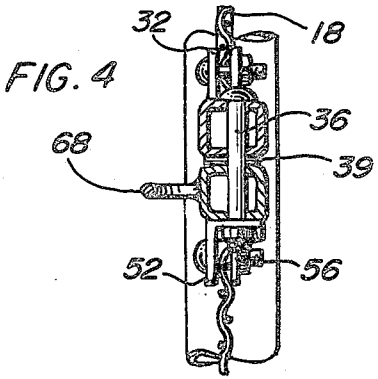
FIG. 4 is a fragmentary enlarged vertical sectional view taken substantially upon the plane indicated by the section line 4—4 of FIG. 1.
Figure 2:
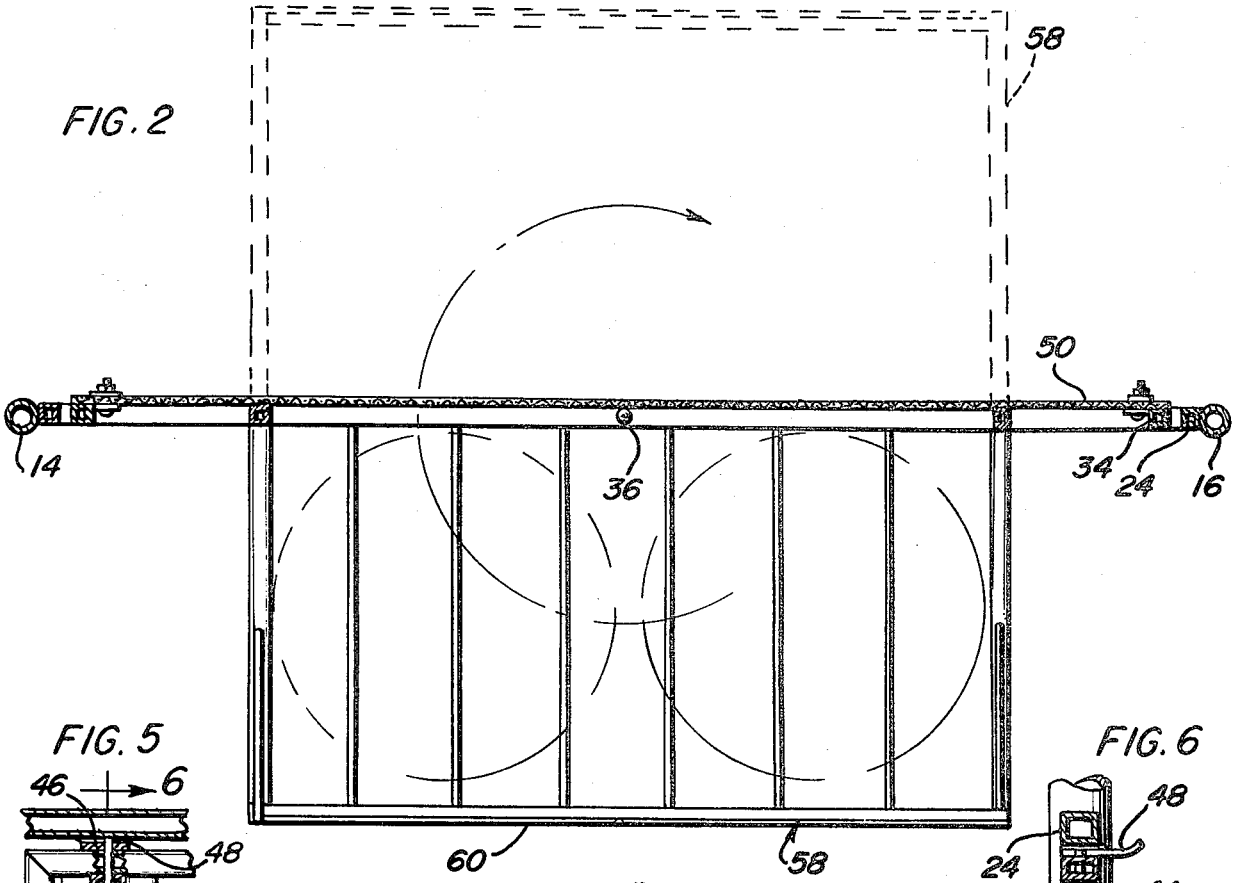
FIG. 2 is an enlarged horizontal sectional view taken substantially upon the plane indicated by the section line 2—2 of FIG. 1.
Figure 5:
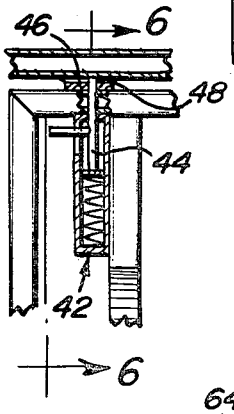
FIG. 5 is an enlarged fragmentary sectional view illustrating a first form of latch for the rotating trash can rack.
Figure 6:
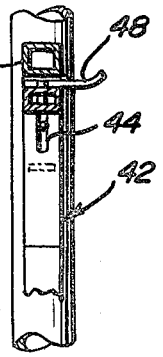
FIG. 6 is a fragmentary vertical section view taken substantially upon the plane indicated by the section line 6—6 of FIG. 5.

The frame 24 supports an inner rectangular frame 34 of slightly smaller width and height dimensions than the internal width and height dimensions of the frame 24 from the latter through the utilization of upper and lower coaxial pivot fasteners 36 and 38 and corresponding pairs of thrust washers 39, see FIGS. 4 and 7, with the fasteners 36 and 38 secured through corresponding upper and lower portions of the frames 24 and 34, see FIGS. 4 and 7. The inner frame 34 may be swung between 180° reversed positions coplanar with the frame 24 and the left side of the frame illustrated in FIG. 1 includes a latch assembly referred to in general by the reference numeral 42 including a spring biased latch member 44, see FIG. 5, extendible and retractable into and from engagement with a latching opening 46 formed in a latch plate 48 welded to the underside of the corresponding end of the stationary frame upper member. In additon, a similar opening equipped latch plate is welded to the underside of the other end of the upper horizontal member of the stationary frome 24 with which the latch member 44 may be releasably engaged in order to retain the inner frame 34 in the reversed position.

The inner frame 34 includes a fence panel 50 supported therefrom by tabs 52 spaced about the frame 34 and to which the panel 50 is secured through the utilization of suitable fasteners 56, see FIG. 4, and a generally horizontal trash receptacle rack referred to in general by the reference numeral 58 is supported from one side of the frame 34 and includes an elevated horizontal outer side member 60 and downwardly and outwardly inclined end members 62 between which a plurality of trash receptacles 64 may be received inwardly of the outer side member 60. Also, the upper portion of the side of the inner frame 34 from which the rack 58 is supported includes a pair of anchor structures 68 to which the trash receptacle lid tether members may be secured. In operation, assuming that the near side of the fence illustrated in FIG. 1 is the inner side thereof, the trash receptacles 64 may be supported on the rack 58 in the manner illustrated in phantom lines FIG. 1 of the drawings and in solid lines in FIG. 3 of the drawings.

Figure 3:
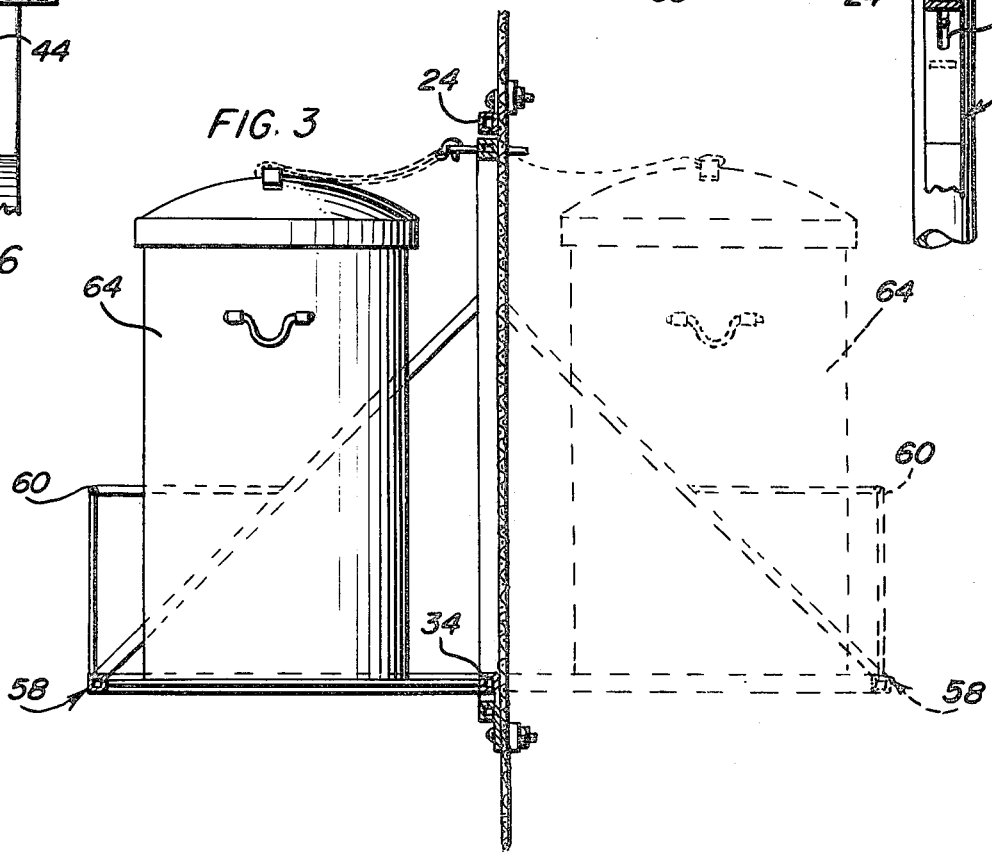
FIG. 3 is an enlarged vertical sectional view taken substantially upon the plane indicated by the section line 3—3 of FIG. 1.

Occasionally, trash may be added to the receptacles 64 as required and on a trash pick-up day, the latch assembly 42 is released and the inner frame 34 is swung about the center axis of the pivot fasteners 36 and 38 to the phantom line position thereof illustrated in FIG. 3 of the drawings and latched in that position. It will, of course, be noted that when the rack 58 is pivoted from the solid line position thereof illustrated in FIG. 3 to the phantom line position thereof illustrated in FIG. 3, the trash receptacle 64 pass through the opening in the fence bound by the stationary frame 24 and are positioned on the outer side of the fence 10. Further, it will be noted that the rack 58 is disposed at an elevation spaced above the lower marginal portion 30 of the fence 10.

Accordingly, the instant invention not only provides a means whereby trash cans may be supported in proper elevated position against rummaging therein by rodents, but the trash receptacles may also be readily shifted from the inner side of the fence 10 to the outer side of the fence 10 for trash pick-up independent of removal of the receptacles 64 from the rack 58 and with very little effort on the part of the person "setting the trash receptacles out for pick-up".

It is to be understood, that the instant invention may be used in conjunction with various different types of fence construction and also other forms of partition forming structures, such as walls and garage doors. Further, the latch assembly 42 may be used on either end of the frame 32.

Figure 8:
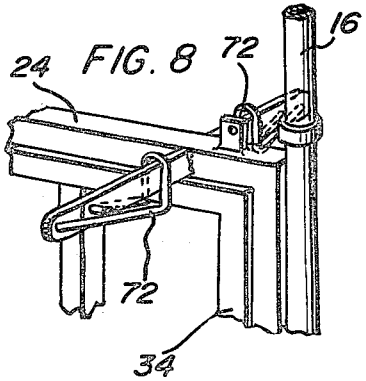
FIG. 8 is a fragmentary perspective view illustrating a second form of latch.

In addition, with attention now invited more specifically to FIG. 8 of the drawings, one end of the upper horizontal member of the stationary frame 24 may be provided with a pair of pivotally supported cam-type gravity latch members 72 for releasably securing the inner frame 34 in reversed positions.

The foregoing is considered as illustrative only of the principles of the invention. Further, since numerous modifications and changes will readily occur to those skilled in the art, it is not desired to limit the invention to the exact construction and operation shown and described, and accordingly, all suitably modifications and equivalents may be resorted to, falling within the scope of the invention.

What is claimed as new is as follows:

1. In combination with a fence section extending and secured between a pair of fence section supporting posts, said section incorporating an upstanding stationary frame defining a horizontal opening through said section, an inner frame received in said stationary frame and supported within the latter for swinging at least substantially 180° relative to said stationary frame about an upstanding axis between end-to-end and side-to-side reversed positions with said inner frame generally coplanar with said stationary frame and fence section, said inner frame including fence panel structure supported therefrom preventing passage horizontally through said inner frame, and horizontal platform means supported from said inner frame and projecting outwardly from at least one side of said fence panel structure for removable support of a trash receptacle bottom therefrom with said receptacle swingable through said opening upon swinging of said inner frame between said reversed positions thereof to shift said receptacle from a position supported on one side of said fence section to the other side of said fence section independent of removal of said receptacle from said platform means.

2. In combination with a fence section extending and secured between a pair of fence section supporting posts, said section incorporating an upstanding stationary frame defining a horizontal opening through said section, an inner frame received in said stationary frame and supported within the latter for swinging at least substantially 180° relative to said stationary frame about an upstanding axis between end-to-end and side-to-side reversed positions with said inner frame generally coplanar with said stationary frame and fence section, said inner frame including fence panel structure supported therefrom preventing passage horizontally through said inner frame, and support means on at least one side of said fence panel structure for removable support of a trash receptacle therefrom swingable through said opening upon swinging of said inner frame between said reversed positions thereof to shift said receptacle from a position supported on one side of said fence section to the other side of said fence section independent of removal of said receptacle from said support means, said fence section including fence panel structure extending between said posts both above and below said stationary frame.

3. The fence section of claim 2 wherein said stationary frame extends substantially fully between said posts.

4. The fence section of claim 2 wherein said fence panel structure includes a wire fence panel.

5. The fence structure of claim 4 wherein said stationary frame extends substantially fully between said posts.

6. The fence structure of claim 2 including latch means operative to releasably latch said inner frame in said reversed positions.

7. In combination with an upstanding fence including upper and lower marginal portions and having a horizontal opening formed therein including upper and lower marginal portions with at least one of said opening marginal portions vertically spaced from the corresponding marginal portion of said fence toward the other marginal portion of said fence, a frame supported within said opening for swinging at least substantially 180° relative to said partition about an upstanding axis between end-to-end and side-to-side reversed positions with said frame generally coplanar with said fence, said frame including fence panel structure supported therefrom preventing passage horizontally through said frame, and generally horizontal platform means supported and projecting outwardly from at least one side of said frame for removable support of a receptacle bottom therefrom on said one side of said frame and swingable through said opening upon swinging of said frame between said reversed positions thereof to shift said receptacle from a position supported on one side of said fence to the other side of said fence independent of removal of said receptacle from said platform means.

8. The fence of claim 7 including latch means operative to releasably latch said frame in said reversed positions.

9. The fence of claim 7 wherein said one of said opening marginal portions comprises said opening lower marginal portion.

* * * * *